United States Patent [19]

Staudt

[11] 3,946,715

[45] Mar. 30, 1976

[54] CENTRIFUGAL RPM GOVERNOR FOR FUEL INJECTED INTERNAL COMBUSTION ENGINES

[75] Inventor: Heinrich Staudt, Markgroningen-Talhausen, Germany

[73] Assignee: Robert Bosch GmbH, Stuttgart, Germany

[22] Filed: Mar. 5, 1974

[21] Appl. No.: 448,202

[30] Foreign Application Priority Data

Mar. 6, 1973 Germany ..... 2311044

[52] U.S. Cl. ..... 123/140 R; 123/140 J

[51] Int. Cl.[2] ..... F02D 1/04

[58] Field of Search ..... 123/140 R, 140 J

[56] References Cited

UNITED STATES PATENTS

| | | | |
|---|---|---|---|
| 3,613,651 | 10/1971 | Snyder | 123/140 R |
| 3,620,199 | 11/1971 | Kuhn | 123/140 R |
| 3,659,570 | 5/1972 | Yoshino | 123/140 R |
| 3,727,598 | 4/1973 | Knapp | 123/140 R |
| 3,766,899 | 10/1973 | Isselhorst | 123/140 R |

*Primary Examiner*—Charles J. Myhre
*Assistant Examiner*—Daniel J. O'Connor
*Attorney, Agent, or Firm*—Edwin E. Greigg

[57] ABSTRACT

In a centrifugal rpm regulator for fuel injected internal combustion engines, a fuel quantity control rod is provided which receives the forces associated with the displacements of an adapter sleeve which, in turn, is displaceable under the influence of centrifugal flyweights and as a function of engine rpm. The regulator also includes an idling control spring, a maximum rpm control spring and an adapter stop having an adaptation spring, with the adapter sleeve comprising two mutually coaxially disposed portions and an intermediate spring therebetween. The pretension force of the intermediate spring is greater than the maximum force of the idling control spring and the pretension force and spring stiffness of the intermediate spring are smaller than the pretension force and spring stiffness of the adaptation spring.

3 Claims, 2 Drawing Figures

CENTRIFUGAL RPM GOVERNOR FOR FUEL INJECTED INTERNAL COMBUSTION ENGINES

BACKGROUND OF THE INVENTION

1. Field of the Invention

The present invention relates to a centrifugal rpm governor, and in particular to a centrifugal rpm governor or regulator for fuel injected, internal combustion engines, especially diesel engines. Centrifugal rpm regulators of the type under consideration are provided with an adapter member (adapter sleeve) that is slidable under the influence of flyweights and in dependence on the rpm of the engine and in opposition to the force of idling and maximum rpm control springs. The adapter sleeve transmits its regulatory motions to a fuel supply quantity setting member which sets the fuel supply quantity of the fuel injection pump, this transmission taking place via at least one two-armed intermediate lever whose pivoting point is adjustable in dependence on the pivoted position of an operating lever. The excursion of the fuel quantity setting member in the direction of an increasing fuel supply quantity is limited by an adjustable stop equipped with a cam plate, which, in turn, is adjustable in dependence on engine rpm, the cam plate being adapted to determine the maximum fuel supply quantity. The stop is fastened by a stud to the regulator housing and is coupled with the adapter member via at least one control lever. The adapter member essentially comprises two mutually coaxially disposed portions, one a transmission member and the other a setting member which are held in their initial position by an intermediate spring installed between the two portions. The transmission member is coupled to the stop and the setting member is coupled to the intermediate lever. After performing an idling stroke, in opposition to the force of the idling control spring, the setting member encounters a stroke limiter which is influenced by the effective force of the top (maximum) rpm control spring. An energy storage mechanism is tensioned as soon as and as long as the intermediate lever attempts to move the fuel supply quantity setting member beyond the stop.

2. Description of the Prior art

A known centrifugal force rpm governor of the above-described construction operates as an idling rpm and maximum rpm regulator in which the position of the injection pump control rod, which serves as the fuel supply quantity setting member, is adjustable in dependence on the pivotal position of an operating lever. Further, a particular idling rpm, determined by an idling control spring, is maintained by control; and a maximum rpm, determined by a top rpm control spring, is limited. Still further, in the region between the idling rpm and the top rpm, the maximum fuel supply quantity is adapted to the full-load characteristics of the engine by an adjustable stop coupled to a transmission member of an adapter sleeve of the regulator. This process is known as a so-called "adaptation process." A cam plate disposed on the stop permits any desired process of adaptation, i.e., the fuel supply quantity of the injection pump can be altered in dependence on the rpm, both in the direction of an increasing, as well as in the direction of a decreasing, fuel supply quantity.

In this known centrifugal force rpm governor, the rpm-dependent path of the transmission member is determined by the pretension and the spring stiffness of an adaptation spring disposed between the transmission member and the setting member of the adapter sleeve. The utility of this governor is limited by the space available for installing the spring which itself is defined by the size of the adapter sleeve. Furthermore, an exchange of the adaptation spring, for example, or a change of the pretension or of the maximum path of the spring is possible only by substantial disassembly of the adapter sleeve and of other structural members of the regulator. The latter structural members include the idling and top rpm springs.

OBJECTS AND SUMMARY OF THE INVENTION

An object of the present invention is to provide a centrifugal rpm governor of the type described above in which the characteristics of the adaptation spring and the spring path can be changed independently of the structural size of the adapter sleeve and where this may occur without influencing the setting of the idling control spring and top rpm control spring and without the disassembly of important structural members of the regulator which determine the fundamental setting of the regulator.

This object and others are accomplished according to the present invention in that a stroke limitation is performed in a per se known manner by an unyielding part of a support lever which is pivotable about a fixed point in the regulator housing and which abuts against a stop, integral with the housing, under the influence of the force of the top rpm control spring. Furthermore, the idling control spring has an adjustable counterbearing which is disposed within the support lever but displaced parallel with respect to the axis of the adapter member, with the pretension force of the intermediate spring being greater than the maximum force of the idling control spring and with the pretension force and spring stiffness of the intermediate spring being smaller than the pretension force and spring stiffness of an adaptation spring which affects a yielding adaptation stop, known per se, and inserted in the support lever coaxially with the adapter member against which the transmission member abuts at the end of the idling stroke. By the combination of the previously-cited characteristics, together with those of the regulator cited at the outset that operates as an idling and top rpm regulator, the objects are achieved with surprising success.

According to one preferred embodiment of the present invention the setting member is guided within the transmission member and has a connecting member coupled to the intermediate lever and extends through at least one opening in the wall of the transmission member. An advantageous further embodiment of the present invention is achieved in that the connecting member consists of at least one lateral bolt guided in a guide slot disposed within the support lever and whose end opposite the adapter member forms the stroke limitation for the idling stroke.

DESCRIPTION OF THE PREFERRED EMBODIMENT

Figure 1:
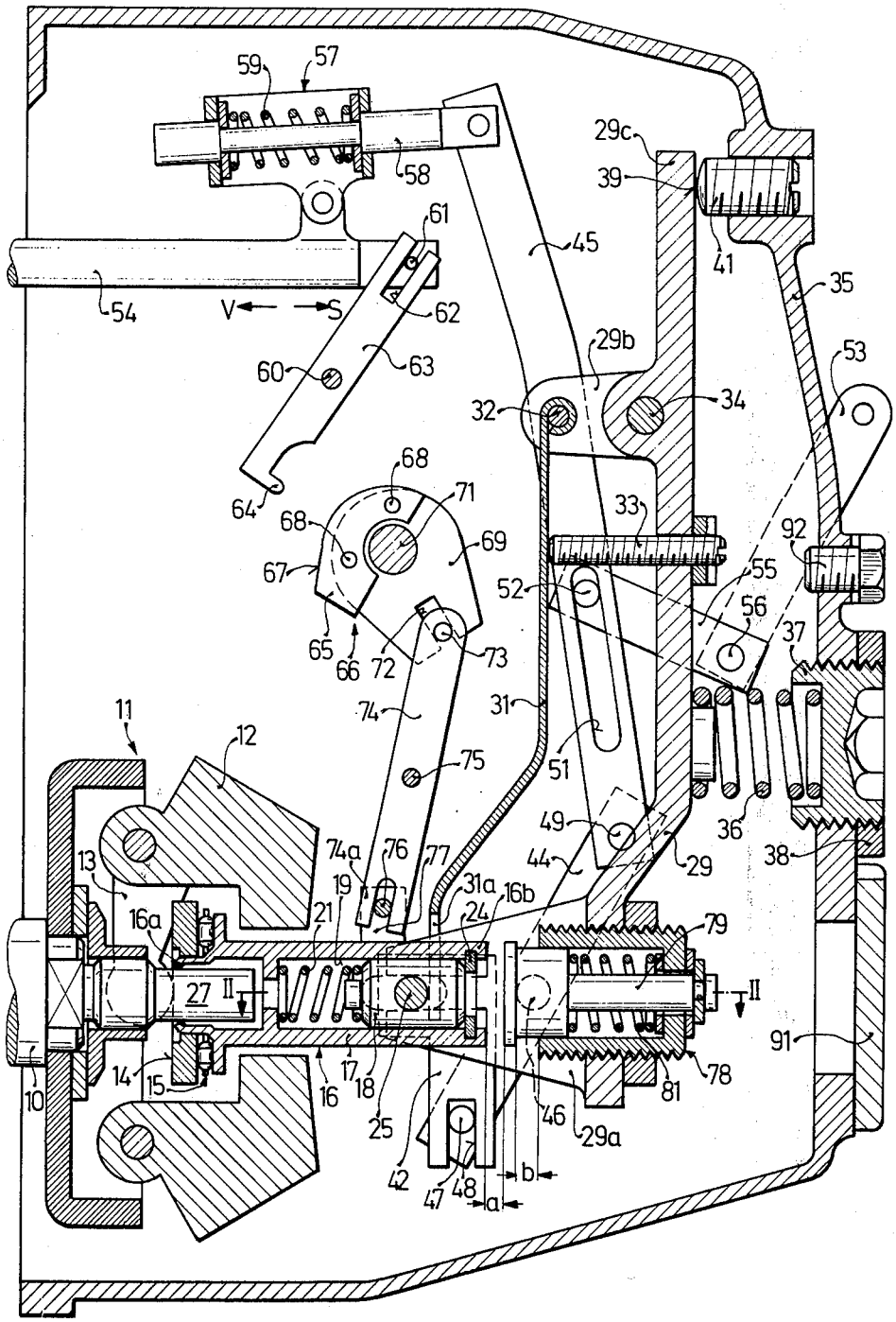
FIG. 1 is a side view in elevation illustrating a longitudinal section through a centrifugal rpm governor according to the present invention.

Turning now to FIG. 1, there is shown a centrifugal rpm governor or regulator having a drive shaft 10 of an injection pump (not shown). Both the regulator and injection pump are used in conjunction with an internal combustion engine. The regulator includes a centrifugal governor 11 which is mounted on the shaft 10. The governor 11 is provided with pivotably mounted flyweights 12 with arms 13 that engage a front surface 14 of a thrust bearing 15. The thrust bearing 15 is mounted on the end 16*a* of a cylindrical extension of an adapter sleeve 16 serving as a control member. The thrust bearing 15 serves to transmit the adjustment forces of the flyweights 12 to the adapter sleeve 16. The adapter sleeve 16 consists essentially of two mutually coaxial portions, a transmission member 17 and a setting member 18. The setting member 18 is slidably mounted within a bore 19 of the transmission member 17 and is held in the installation position shown in FIGS. 1 and 2 by an intermediate spring 21. The intermediate spring 21 is supported on the one hand by a shoulder 22 in the bore 19 and on the other hand by one axial end surface of the setting member 18. The setting member 18 includes another axial end surface 23 which is pressed against a snap ring 24 inserted in the transmission member 17 to serve as a position limiter for the setting member 18. The setting member 18 is equipped with a transverse bolt 25 inserted transversely to its longitudinal axis. The transverse bolt 25 is fixed against rotation and includes two ends 25*a* and 25*b* which extend beyond the periphery of the adapter sleeve 16. This is made possible by openings 26 in the form of longitudinal slots machined into the wall of the transmission member 17. The openings 26 are open in the direction of the end 16*b* of the adapter sleeve 16, for the purpose of installing the setting member 18. These openings are long enough to enable a yielding motion, which will be described below, of the setting member 18 in opposition to the force of the intermediate spring 21.

The end 16*a* of the adapter sleeve 16 is slidably carried on a cylindrical guide or boss 27 of the drive shaft 10, while the guidance of the other end 16*b* of the adapter sleeve 16 is accomplished by the transverse bolt 25. The two ends 25*a* and 25*b* are guided in guide slots 28 of a support lever 29. The guide slots 28 are machined into mutually parallel guide arms 29*a* of the support lever 29, which, in turn, laterally envelop the adapter sleeve 16. The closed end 28*a* of the guide slots 28 serve as stroke limiters for the idling stroke of the regulator. The idling stroke is determined by the stroke of the transverse bolt 25 and is designated in FIG. 1 by *a*. The idling stroke *a* is transversed in opposition to the force of an idling control spring 31, embodied as a leaf spring, which is fastened to an extension 29*b* of the support lever 29 by means of a bolt 32. The support lever 29 carries an adjustable counter support bearing 33 embodied as a screw bolt which is adjustable for the purpose of changing the pretension of the idling control spring 31. The bolt 33 is screwed into the support lever 29 parallel too the axis of the adapter sleeve 16. The idling control spring 31 has an end 31*a* which is formed into the shape of a fork which embraces the transmission member 17 and which is engaged with the adapter sleeve 16 via the transverse bolt 25 (see especially FIG. 2). This arrangement of the idling control spring 31 has the advantage that when the idling stroke *a* has been traversed, it is not further moved during the remaining regulatory motions of the centrifugal rpm governor and hence is made inactive.

The support lever 29 is pivotably mounted to a housing 35 of the regulator by a bolt 34. The support lever 29 is influenced by the effect of the force of a top rpm control spring 36 supported on the one hand by the support lever 29 and on the other hand by an adjustable counterbearing 37 screwed into the regulator housing 35 and held in the adjusted position by a lock nut 38. Through the effect of the force of the top rpm control spring 36, the end 29*c* of the support lever 29 is pressed against a stop 39 fixed to the housing 35. The stop 39 is formed by the face of a stop screw 41 screwed into the regulator housing 35. In this way, the support lever 29 is held in its vertical normal position, as shown, until such time as a force deriving from the flyweights 12 and exerted by the adapter sleeve 16 on the support lever 29 is greater than the force of the top rpm control spring 36.

A lever 42 is connected on one end 25*a* of the transverse bolt 25 so that it will not rotate (FIG. 2), and together with the transverse bolt 25 forms a connecting member 43 which is mediately coupled to an intermediate lever 45 through the intermediate action of a motion regersing lever 44. The intermediate lever 45 is embodied as a slotted lever. The motion reversing lever 44 serves only and in a known manner for the reversal of motion of the intermediate lever 45 and is carried by a bolt 46 in the regulator housing 35. If this motion reversal is not desired, the transverse bolt 25 can also be coupled directly and pivotably with the intermediate lever 45. One arm of the motion reversing lever 44 has a bolt 47 which engages a guide slot 48 (FIG. 1) in the lever 42, while the other lever arm of the reversing lever 44 is pivotably connected with the intermediate lever 45 via a connecting bolt 49.

The intermediate lever 45 is embodied in a known manner as a two-armed slotted lever having a pivot stud 52 guided in a guide slot 51; the position of the stud 52 is changeable depending on the pivotal position of an operating arm 53 for changing the fuel supply quantity to be set by a control rod 54 serving as a fuel quantity adjustment member. The stud 52 extends in a known manner from a guide lever 55 which, in turn, is connected with the operating arm 53 via an adjustment shaft 56 mounted in the regulator housing 35. The control rod 54 and the intermediate lever 45 are connected with one another via a tab 58 equipped with an energy storing mechanism 57.

The energy storing mechanism 57 is equipped with a compression spring 59 and permits a further movement of the tab 58 and therefore also of the intermediate lever 45 in both of two possible directions of motion, i.e., whenever the control rod 54 is prevented from further motion, either in the direction of arrow V for controlling the maximum fuel supply quantity or in the direction of arrow S in the stop position.

Mounted on that end of the control rod 54 which extends into the regulator is a pin 61 which engages a slot 62 formed in one end of a stop lever 63. The stop lever 63, in the exemplary embodiment shown, is a two-armed lever mounted by a stud 60 to the housing 35. The stud 60 defines a pivot axis which is adjustable in the direction of the axis of the regulator. The stop lever 63 is equipped at its other end with a cam follower nose 64 which engages a cam plate 65 of a stop 66. The nose 64 engages the stop 66 during motions of the control rod 54 in the direction of maximum fuel supply (in the direction of arrow V) and in this way the stop 66 controls the maximum fuel supply quantity to be supplied which, in turn, corresponds to the curved cam surface 67 of the cam plate 65. This control of the full-load supply quantity of the injection pump is known as so-called "adaptation". The cam plate 65 is attached at points 68 to a motion transfer plate 69 of the stop 66, and the motion transfer plate 69 is rotatably mounted to the housing 35 by a stud 71. The motion transfer plate 69 includes an engaging slot 72 within which a pin 73 is received. The pin 73 is mounted to a guide lever 74 which, in turn, is pivotably mounted by a stud 75 to the housing 35. The guide lever 74 engages a stud 76 with its fork-shaped end 74, the stud 76 being fixedly connected by a tab 77 with the transmission member 17 of the adapter sleeve 16. During the motions of the transmission member 17, which serves as an adaptation sleeve in a manner further described below, the guide lever 74 and hence the stop 66 is pivoted or turned from the position shown into a position corresponding to the position of the displaced transmission member 17.

As an extension of the axis of the adapter sleeve 16, an elastically yielding adaptation stop 78 is inserted in the support lever 29. The essential structural member of the stop 78 is a stop pin 79 (see also FIG. 2) which is acted upon by an adaptation spring 81. The adaptation spring 81 is supported on the one hand against a shoulder 82 of the stop bolt 79 and on the other hand mediately against a bottom surface 83 of a bore 84, which serves for guiding the stop bolt 79. The bore 84 is machined into a threaded bushing 85. A disc 86 disposed between the adaptation spring 81 and the bottom surface 83 of the bore 84 serves for adjusting the pretension of the adaptation spring 81. The stop bolt 79 is held in its installed position by a snap ring 87 and the stroke *b*, controllable by the adaptation stop 78, can be adjusted by exchanging a disc 90 for another having a different thickness.

The idling stroke *a* of the regulator is so adjusted that it is equal to the distance of the transverse bolt 25 from the closed ends 28*a* (stroke limit). The face of the stop bolt 79 facing toward the adapter sleeve 16 is designated with the numeral 88 in FIG. 2. The face of the transmission member 17 lying opposite face 88 is designated 89 and the distance between the two is set for purpose of setting the idling stroke *a* (FIG. 1) by rotating the threaded bushing 85 of the stop 78 within the support lever 29. A removable cover 91 provides access to the adaptation stop 78 and therefore makes possible adjustment thereof or an exchange thereof without influencing other structural members. The removal of a closure screw 92 permits access to the adjustable counterbearing 33 of the idling control spring 31.

Figure 2:
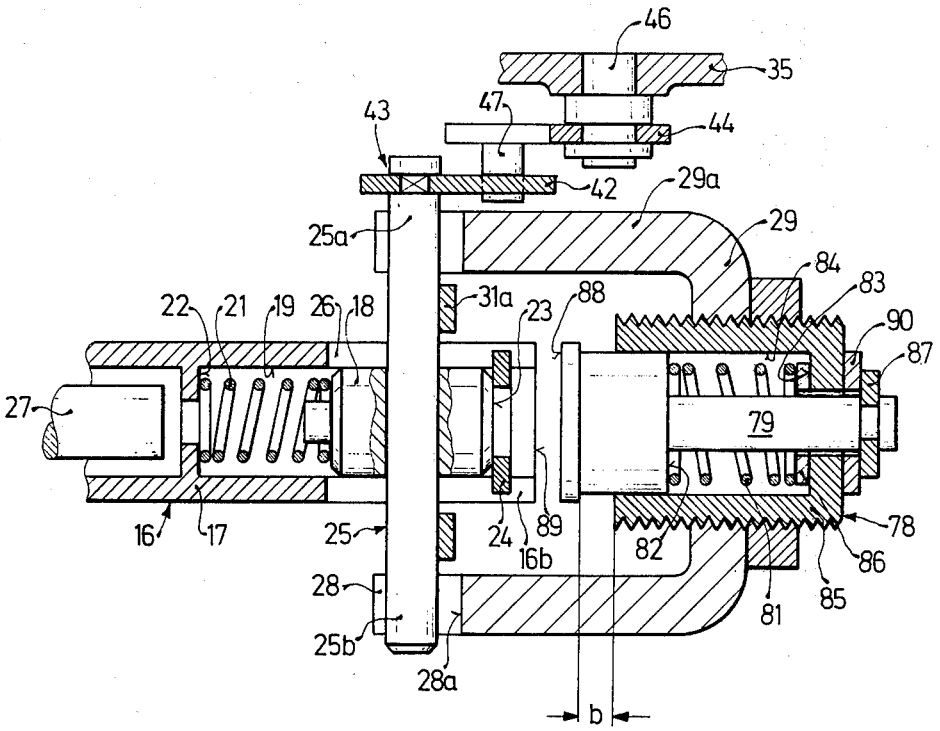
FIG. 2 is a cross-sectional view taken along the line II—II of FIG. 1.

It is a prerequisite for the desired operation of the centrifugal rpm governor according to the present invention that the pretension $P_Z$ of the intermediate spring 21 is greater than the maximum force $P1_{max}$ of the idling control spring 31; and that the pretension $P_Z$ and the spring stiffness $C_Z$ of the spring 21 are smaller than the pretension $P_a$ and the spring stiffness $C_a$ of the adaptation spring 81. The fact that the pretension $P_Z$ of the intermediate spring 21 is larger than the maximum force $P1_{max}$ of the idling control spring 31 has the effect that in the region of idling regulation, during which the adapter sleeve 16 traverses the idling stroke *a*, the setting member 18 and the transmission member 17 act like a fixed member and, thus, the regulatory motions which are transmitted in the idling control region from the flyweights 12 via the arms 13 onto the adapter sleeve 16, are directly transmitted to the control rod 54 via the motion reversing lever 44, the intermediate lever 45 and the tab 58. For regulating the idling rpm, the operating arm 53 and the guide lever 55 connected thereto have been pivoted by a small amount in the counterclockwise sense. With the connecting bolt 49 fixed, the intermediate lever 45 is also pivoted counterclockwise and moves the control rod 54 via the tab 58 by a correspondingly small amount in the direction of arrow V. When the engine is running, the adapter sleeve 16 moves in the region of the idling stroke *a* and the fuel supply quantity corresponding to maintaining the idling rpm is controlled by the control rod 54 in a known manner. Because of the fact that the regulatory paths traversed by the control rod 54 during idling regulation are substantially smaller than the full-load regulatory path, the cam-follower nose 64 of the stop lever 63 does not contact the curved cam surface 67 of the stop 66 in the above-described motion of the control rod 54. Thus the control rod 54 can move freely. In the centrifugal force rpm regulator according to the present invention, which operates as an idling and top rpm regulator, all the movable parts in FIGS. 1 and 2 are shown in that position which they occupy when the engine is standing still and the operating arm 53 is in the shutoff position.

Having described the operation of the regulator during idling rpm regulation, regulator operation when maximum power, i.e., full-load power is demanded from the engine, will now be considered.

For the purpose of controlling the full-load power of the engine and the corresponding full-load fuel supply quantity, the operating arm 53 and the guide lever 55 fixedly connected thereto are either pivoted from the previously-described idling position or from the illustrated shutoff position, in the counterclockwise sense, until the operating arm 53 abuts a known full-load stop (not shown). In this process, the intermediate lever 45 is pivoted about its connecting bolt 49 in such a way that it moves the tab 58 and thus moves the control rod 54 in the direction of arrow V. This motion of the control rod 54 terminates when the cam-follower nose 64 of the stop lever 63, which is pivotable about its pivot stud 60, abuts the curved cam surface 67. If the adapter sleeve 16 is still in its illustrated position, then the energy storage mechanism is pretensed by an amount corresponding to the motion of the tab 58 caused by the intermediate lever 45 during the idling stroke *a* of the adapter sleeve 16.

When, during increasing rpm, the adapter sleeve 16 has traversed the idling stroke *a* in opposition to the force of the idling control spring 31, then the face 89 abuts the face 88 of the stop bolt 79 of the adaptation stop 78. During this process, the lever 42 connected with the setting member 18 has moved the intermediate lever 45 through the action of the motion reversal lever 44, so that the energy storage mechanism 57 is relaxed again.

Depending on the shape of the curved cam surface 67, it might be necessary that an appropriate pretension of the energy storage mechanism 57 must be present for the equalization of path differences effected by the curved surface 67.

When the rpm increases further, the forces exerted by the adapter sleeve 16, due to the centrifugal forces developed by the flyweights 12, are transmitted according to the present invention only by the transmission member 17 onto the adaptation stop 78 or its stop bolt 79. This occurs because after the idling stroke *a* has been traversed, the transverse bolt 25 of the setting member 18 is held fast to the end 28*a* of the guide slot 28 in the support lever 29. This separation between the setting member 18 and the transmission member 17 makes possible a flawless idling and top regulating characteristic of the regulator. Thus, by pivoting the operating arm 53, any desired partial load position of the control rod 54 can be set, independent of the prevailing rpm, in the region between the idling rpm and the top rpm to be limited. This is so because when the transverse bolt 25 has reached its stroke limit against the end 28*a*, the motion reversal lever 44 retains its position and thus the connecting bolt 49 serves as a fixed pivotal point for the intermediate lever 45.

When the idling stroke *a* has been traversed, and the rpm increases, and if the setting member 18 remains stationary, only the transmission member 17 moves in the direction toward the support lever 29 corresponding to the yielding movement of the stop bolt 79. During this process, the guide lever 74 turns stop 66 and the curved cam surface 67 of stop plate 65 moves past the cam-follower nose 64 of the stop lever 63 connected to the control rod 54, and, depending on the shape of the curved cam surface 67, the control rod 54 is displaced in the direction of arrow V, i.e. in the direction of an increasing fuel supply quantity, or in the direction of arrow S, i.e. in the direction of a decreasing fuel supply quantity. The shape of the curved cam surface 67 shown in FIG. 1 is such that, during the adaptation stroke *b* of the stop bolt 79, it causes at first a decreasing and subsequently an increasing fuel supply quantity. During this adaptation regulation and when the intermediate lever 45 is stationary, the spring storage mechanism 57 is tensed and subsequently relieved. If an opposite adaptation process is desired, then the previously pretensed spring 59 of the energy storage mechanism 57 is first relieved and then tensed again.

During the further motion of the transmission member 17, which can also be designated as an adaptation sleeve, by an amount equal to the adaptation stroke *b*, the intermediate spring 21 is compressed if the setting member 18 remains stationary and, at the same time, the adaptation spring 81 yields by the same amount.

It is possible that the cam plate 65 can be equipped in a known fashion with an offset (not shown) for controlling a starting excess fuel quantity and, by an appropriate shaping of the curved cam surface 67, any desired adaptation process can be realized.

If, in a partially loaded or unloaded engine, during further increasing rpm, the maximum rpm determined by pretensioning of the top rpm regulating spring 36 is exceeded, which is equivalent to a sleeve path greater than $a + b$, then the support lever 29 is pivoted counterclockwise about its fixed point 34 by the adapter sleeve 16 in opposition to the force of the top rpm regulating spring 36.

Since the stroke limiter end surface 28*a* of the transverse bolt 25 of the setting member 18 is a fixed structural member of the support lever 29, the transverse bolt 25 also moves away from the drive shaft 10 by the same amount as the transmission member 17 abutting the stop bolt 79. During this motion of transverse bolt 25, the motion reversal lever 44, pivotable about pivotal axis 46, is so pivoted by means of the lever 42 connected to the transverse bolt 25 that its connecting pin 49 rotates the intermediate lever 45 clockwise about its pivot 52 and, through tab 58, it moves the control rod 54 in the direction of arrow S into a position in which the fuel supply quantity of the injection pump is reduced until it corresponds to the power demanded from the engine and the rpm is held within the P-region or until such time as the fuel supply is entirely shut off.

Thus, by using the previously-describedd centrifugal force rpm regulator, operating as an idling and top rpm regulator, and desired adaptation process can be controlled in an advantageous manner in the speed region between the idling rpm and the top rpm in which no regulatory motions take place otherwise. The adaptation stop 78, which influences the rpm-dependent course of the adaptation stroke *b*, is so disposed, according to the present invention, that it can be adjusted or exchanged independently of and without influence on the setting of the idling control spring 31 and of the top rpm control spring 36 and this setting or exchange can occur in an advantageous manner without influencing the installed position of any movable part of the regulator.

That which is claimed is:

1. In a centrifugal rpm regulator for fuel injection regulation for fuel injected internal combustion engines, especially diesel engines, including a housing mounting; centrifugal weight means, an adapter sleeve slidably displaceable under the influence of the centrifugal weight means as a function of engine rpm and in opposition to the force of an idling control spring and a maximum rpm control spring, at least one two-armed intermediate lever, an operating arm, a fuel quantity control member, the adapter sleeve transmitting the forces associated with its controlled motions resulting from its slidable displacement through the intermediate lever to the fuel quantity control member for adjusting the fuel quantity delivered by an injection pump used in conjunction with the governor, the intermediate lever having a pivot point which is changeable in dependence on the pivotal position of the operating lever, the movement of the control member being limited in the direction of increasing fuel supply by an adjustable stop means having a cam plate which determines the maximum fuel supply quantity, at least one control arm which couples the stop means with the adapter sleeve thus rendering the position of the cam plate adjustable in dependence on engine rpm, the adapter sleeve including a transmission member and a setting member forming two coaxially disposed portions and an intermediate spring therebetween which biases the transmission member and the setting member toward an initial position which they can assume, the transmission member being coupled to the stop means by the control arm and the setting member being coupled to the intermediate lever by connecting means, an energy storing mechanism mounted between the control member and the intermediate lever, the energy storing mechanism including a spring which is tensioned when the intermediate lever moves the control member beyond the stop means, and stroke limiting means which is effected by the force of the maximum rpm control spring, such that the setting member moves against the idling control spring during the idling stroke of the governor and engages the stroke limiting means at the completion of the idling stroke, the improvement comprising:

a. a support lever;

b. means pivotably mounting said support lever to the housing; and c. a support lever stop mounted to the housing, wherein, the maximum rpm control spring biases one end of the support lever against the support lever stop, the support lever has a yieldable adapter stop means mounted at its other end to be coaxial with the adapter sleeve, the adapter stop means including an adaptation spring and an abutment surface against which the transmission member abuts at the end of the idling stroke of the governor, the support lever has an adjustable counter bearing mounted between its two ends to extend in a direction parallel with respect to the axis of the adapter sleeve for engaging the idling control spring, the pretension force of the intermediate spring is greater than the maximum force of the idling control spring, and the pretension force of the intermediate spring and its spring stiffness are smaller than the pretension force and spring stiffness of the adaptation spring.

2. The regulator as defined in claim 1, wherein the setting member is guided within the transmission member, wherein the transmission member has at least one opening therein, and wherein the connecting means coupling the setting member to the intermediate lever extends through said one opening.

3. The regulator as defined in claim 2, wherein the connecting means includes at least one transversely extending bolt, wherein the support lever includes an extended arm portion having a slot therethrough, wherein the bolt extends through said one opening and said slot, and wherein an end wall of said slot defines the stroke limiting means.

* * * * *